US011691190B2

(12) United States Patent
Biffi

(10) Patent No.: US 11,691,190 B2
(45) Date of Patent: Jul. 4, 2023

(54) FUME CUPBOARD PROVIDED WITH IMPROVED ACCESSIBILITY TO THE SASH TRANSMISSION SYSTEM

(71) Applicant: BICASA S.R.L., Bernareggio (IT)

(72) Inventor: Fabio Biffi, Bernareggio (IT)

(73) Assignee: BICASA S.R.L., Bernareggio (IT)

( * ) Notice: Subject to any disclaimer, the term of this patent is extended or adjusted under 35 U.S.C. 154(b) by 452 days.

(21) Appl. No.: 16/627,999

(22) PCT Filed: Jul. 13, 2018

(86) PCT No.: PCT/IB2018/055190
§ 371 (c)(1),
(2) Date: Dec. 31, 2019

(87) PCT Pub. No.: WO2019/021101
PCT Pub. Date: Jan. 31, 2019

(65) Prior Publication Data

US 2020/0215591 A1 Jul. 9, 2020

(30) Foreign Application Priority Data

Jul. 26, 2017 (IT) ..... 102017000085216

(51) Int. Cl.

| | |
|---|---|
| ***B08B 15/02*** | (2006.01) |
| ***B25H 1/20*** | (2006.01) |
| ***E06B 3/44*** | (2006.01) |
| ***F25D 23/02*** | (2006.01) |

(52) U.S. Cl.
CPC ..... *B08B 15/023* (2013.01); *B25H 1/20* (2013.01); *B08B 2215/003* (2013.01); *E05Y 2900/132* (2013.01); *E06B 3/44* (2013.01); *F25D 23/021* (2013.01)

(58) Field of Classification Search
CPC .... B08B 15/023; E05Y 2900/132; E06B 3/44
See application file for complete search history.

(56) References Cited

U.S. PATENT DOCUMENTS

| | | | |
|---|---|---|---|
| 2,199,182 | A | 4/1940 | Leonard |
| 2,701,896 | A | 2/1955 | Fritz |
| 2,819,666 | A | 1/1958 | Mcneil |

(Continued)

FOREIGN PATENT DOCUMENTS

CN 103726751 A 4/2014

OTHER PUBLICATIONS

International Search Report for PCT/IB2018/055190 dated Nov. 8, 2018.

(Continued)

*Primary Examiner* — Natasha N Campbell
(74) *Attorney, Agent, or Firm* — Hedman & Costigan, P.C.; James V. Costigan; Kathleen A. Costigan

(57) ABSTRACT

A fume cupboard, of the type comprising a framework with two front uprights (2*a*,2*b*), two rear uprights (3*a*,3*b*), a rear panel (11), two side panels (6,7), an upper panel (8) and a sash (4) consisting of a frame (12) and at least one panel (13) for closing an inner chamber (1 0) of said fume cupboard (1). The fume cupboard of the invention comprises a transmission system (14) for transmission of the vertical movements of said sash (4) located inside the abovementioned front uprights (2*a*,2*b*), or inside said front uprights (2*a*,2*b*) and said rear uprights (3*a*,3*b*).

10 Claims, 19 Drawing Sheets

(56) References Cited

U.S. PATENT DOCUMENTS

| | | | | |
|---|---|---|---|---|
| 4,377,969 | A | 3/1983 | Nelson | |
| 5,216,782 | A * | 6/1993 | Schenck | E05F 15/665 454/56 |
| 9,674,981 | B1 * | 6/2017 | Cox | H05K 7/1488 |
| 2004/0083769 | A1 * | 5/2004 | Kim | D06F 37/28 134/58 DL |
| 2017/0331268 | A1 * | 11/2017 | Rosenberg | G02B 6/4403 |

OTHER PUBLICATIONS

Written Opinion of the International Searching Authority dated Nov. 8, 2018.
English Abstract for CN 103726751 A dated Apr. 16, 2014.

* cited by examiner

FUME CUPBOARD PROVIDED WITH IMPROVED ACCESSIBILITY TO THE SASH TRANSMISSION SYSTEM

BACKGROUND OF THE INVENTION

The present invention concerns a fume cupboard provided with improved sash.

Fume cupboards are protection devices provided with a forced suction work chamber, inside which tests can be carried out with chemical substances that create toxic fumes or in any case dangerous substances for the operator. Access to this inner chamber is by means of a door with a vertically sliding frame, named sash, in which a sheet of transparent material, preferably glass, is supported by said frame and has the function of providing front closure of the fume cupboard.

For the vertical movement of the sash relative to the framework of the fume cupboard, one or more counterweights are commonly used, connected to the sash frame by means of pulleys, bearings, wires or belts, where the counterweights are located behind and on the outside of the rear wall of the fume cupboard, in the limited space which usually separates this rear wall from the wall against which the fume cupboard is positioned when installed.

The described arrangement of the counterweight mechanism for control of the sash movements obstructs cleaning and maintenance operations thereon, considering the weight, volume and connection of the fume cupboard to the fume extraction system.

Furthermore the described positioning of the handling mechanism of the sash on the outside, behind the rear wall of the fume cupboard, lengthens the path of the connection cables to the front sash, thus contributing to the creation of friction which in turn increases the forces necessary to move the sash.

All the components of the described sash handling mechanism (pulleys, bearings, wires or belts) are furthermore positioned outside, therefore in an environment not protected against the aggressive action of the fumes extracted from the work chamber of the fume cupboard, thus being subject to dirt and consequent damages to the mechanical parts of the system.

SUMMARY OF THE INVENTION

The main object of the present invention is to produce a fume cupboard provided with an improved sash on which, unlike the similar equipment of the known art, maintenance work can be performed rapidly and simply, without the traditional need to move the fume cupboard from the wall against which it is positioned, in order to create the space necessary to access the counterweight mechanism.

A further object of the invention is to produce a fume cupboard provided with a sash which is simpler and less expensive than those known, traditionally positioned on the outside and behind the rear wall of the fume cupboard.

A further object of the invention is to produce a fume cupboard in which all the components of the sash handling mechanism are at least partly arranged in a closed environment protected from the aggression of the chemical agents present inside the fume cupboard.

Lastly, a further object of the invention is to produce a fume cupboard which, unlike the similar equipment of the known art, allows the sash to be changed rapidly and simply, without having to disassemble the operating counterweight mechanism from the body of the fume cupboard.

These and further objects are achieved by the fume cupboard of claim 1. Preferred embodiments of the fume cupboard of the invention are described in the remaining claims.

Compared to the fume cupboards of the known art, the one of the invention offers the advantage that, due to the positioning of the counterweight mechanism, pulleys, bearings, cables and belts on the sides of the body of the fume cupboard, access to said mechanism no longer requires having to work in the limited space between the rear wall of the fume cupboard and the wall against which the latter is positioned. Hence the possibility of intervening on the sash in a simpler, more practical and more rapid manner compared to those mounted on the outside of the rear wall of the traditional fume cupboards, in particular thanks to the presence of the openable door on the uprights of the fume cupboard.

In fact, the openable door on the uprights of the fume cupboard of the invention allows access to the mechanism that transmits the movements to the sash, without having to disassemble the framework of the fume cupboard and without having to disconnect the fume extraction hose from the body of the fume cupboard.

The fume cupboard of the invention furthermore has the advantage of presenting a simpler and less expensive sash than the sashes of the known fume cupboards, due to the use of fewer components, moreover positioned in an environment protected from the attack of chemical agents present inside the fume cupboard.

The fume cupboard of the invention also has the advantage of allowing replacement of the sash, leaving on the latter the relative operating mechanism, which makes the replacement operation simpler, more practical and more rapid compared to the operation required on the traditional fume cupboards.

BRIEF DESCRIPTION OF THE DRAWINGS

These and other objects, advantages and characteristics are made clear by the following description of some preferred embodiments of the fume cupboard of the invention illustrated, by way of non-limiting examples, in the figures of the accompanying drawings.

In them.

DISCLOSURE OF PREFERRED EMBODIMENTS

Figure 1:
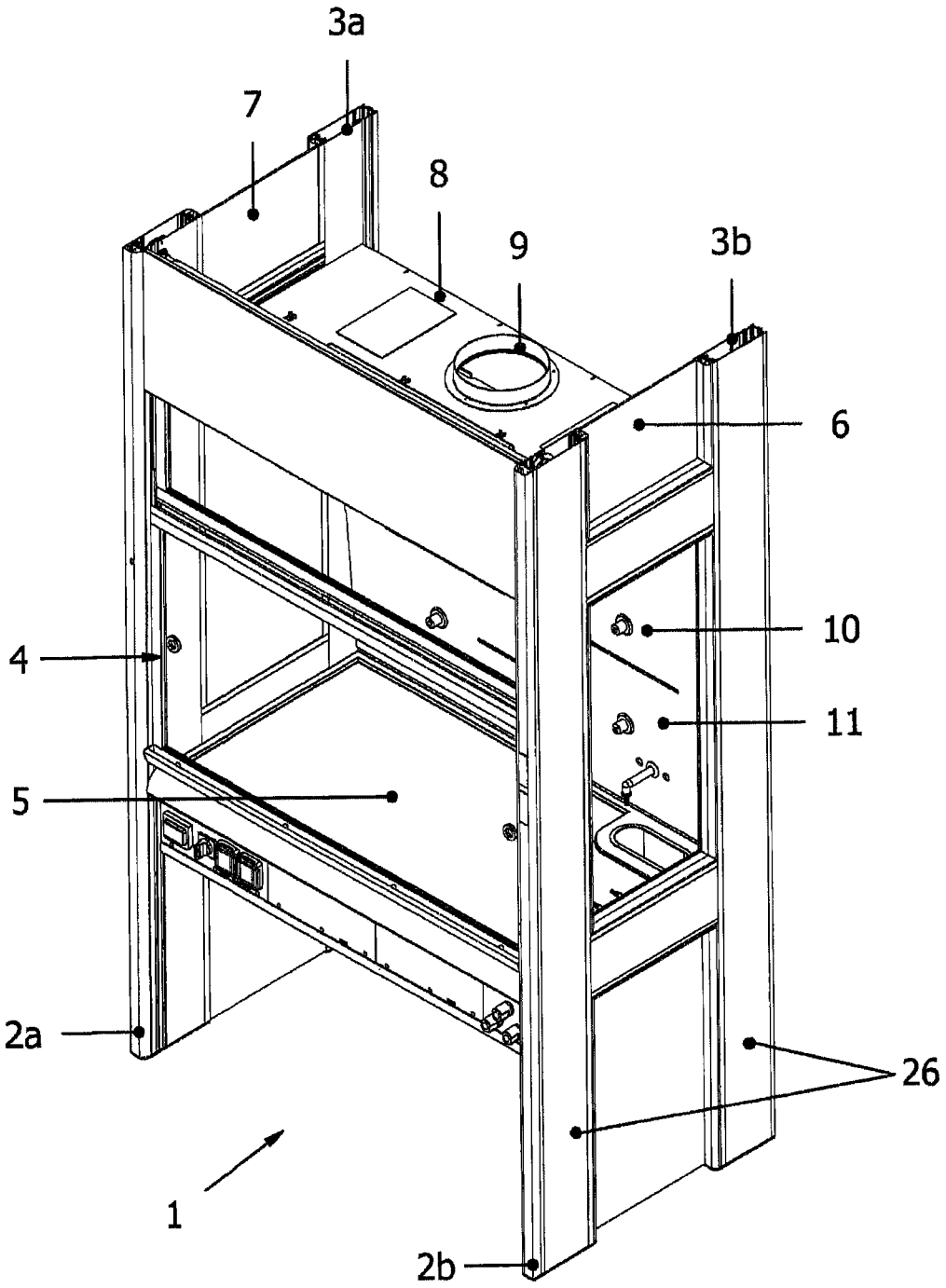
FIG. 1 illustrates in an overall perspective view a first example of fume cupboard of the invention.

The fume cupboard of the invention is indicated overall by 1 in FIG. 1. It has a substantially parallelepiped-shaped framework, in which two front uprights 2*a*,2*b* and two rear uprights 3*a*,3*b* can be distinguished. A sash 4 is in turn provided, sliding vertically between the above-mentioned front uprights 2*a*,2*b* and in front of a chamber 10 inside the fume cupboard 1, having a work surface 5 on which the containers of the chemical substances are rested, the fumes of which are extracted by the fume cupboard.

The fume cupboard 1 is completed by two lateral panels 6 and 7 arranged between the relative front and rear uprights, an upper panel 8 which can be provided with a suction hole 9 for the extraction of the fumes from the chamber 10 of the fume cupboard 1 and a rear closing panel 11.

Figure 2:
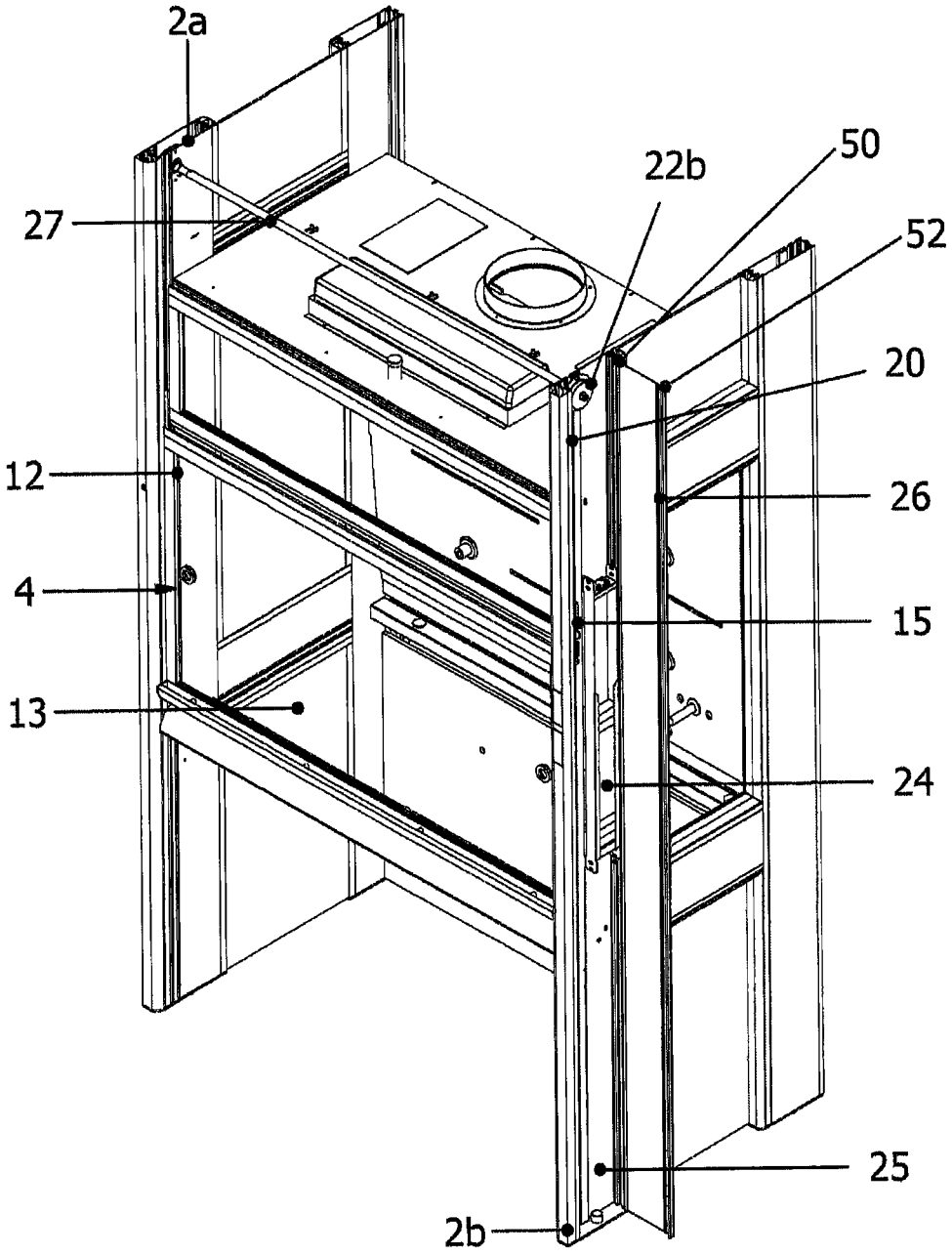
FIG. 2 illustrates the fume cupboard of FIG. 1, with view of the sash movement transmission system, positioned on the side of the front uprights.

As illustrated in FIG. 2, the sash 4 is composed of a frame 12 inside which a panel 13 of transparent material is supported, for example glass, acting as a closing door of the inner chamber 10 of the fume cupboard.

The vertical movements of the sash 4 are achieved by means of the transmission system 14 of FIGS. 2 to 5 and 10. Said system comprises a plate 15 fixed to the frame 12 by means of a block element 16, while the screws 17 fix the block element 16 to the plate 15 and similar screws 18 serve to fix the frame 12 to the block element 16. The end 19 of a cogged transmission belt 20 is furthermore fixed to the plate 15, at a bracket 21 mounted in a sliding manner on said plate 15. The belt 20 is then wound on a return pulley 22 pivoted at the upper end of the above-mentioned front upright 2*b* and is fixed, at its opposite end 23, to a counterweight 24.

Advantageously and according to the invention, the described transmission system for transmitting the movements to the sash 4 is housed in an internal space 25, formed inside the front upright 2*b* and closed by means of a door 26 forming part of said upright. A similar transmission system is also provided inside the internal space 25 of the other front upright 2*a* of the fume cupboard of the invention.

As better illustrated in FIGS. 2, 3*a*, 3*b* and 12, the internal space 25 of the uprights 2*a*,2*b* of the fume cupboard 1 is closed by a side door 26, with shape corresponding to that of the upright on which it closes, completing the structure thereof.

According to a preferred embodiment of the fume cupboard of the invention, said door 26 has a first longitudinal edge provided with a hinge coupling with the corresponding longitudinal first edge of the upright 2*b* and a second longitudinal edge provided with a snap coupling with the corresponding longitudinal second edge of the same upright.

Figure 3:
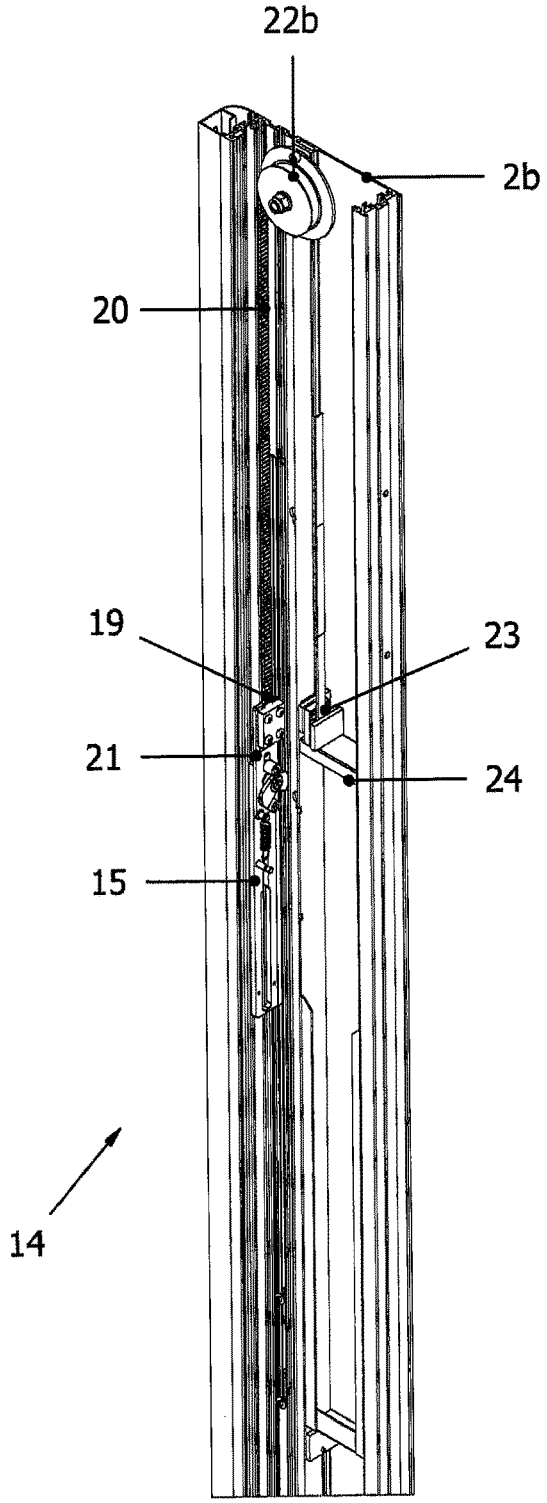
FIG. 3 illustrates schematically the details of the system of FIG. 2.
Figure 3A:
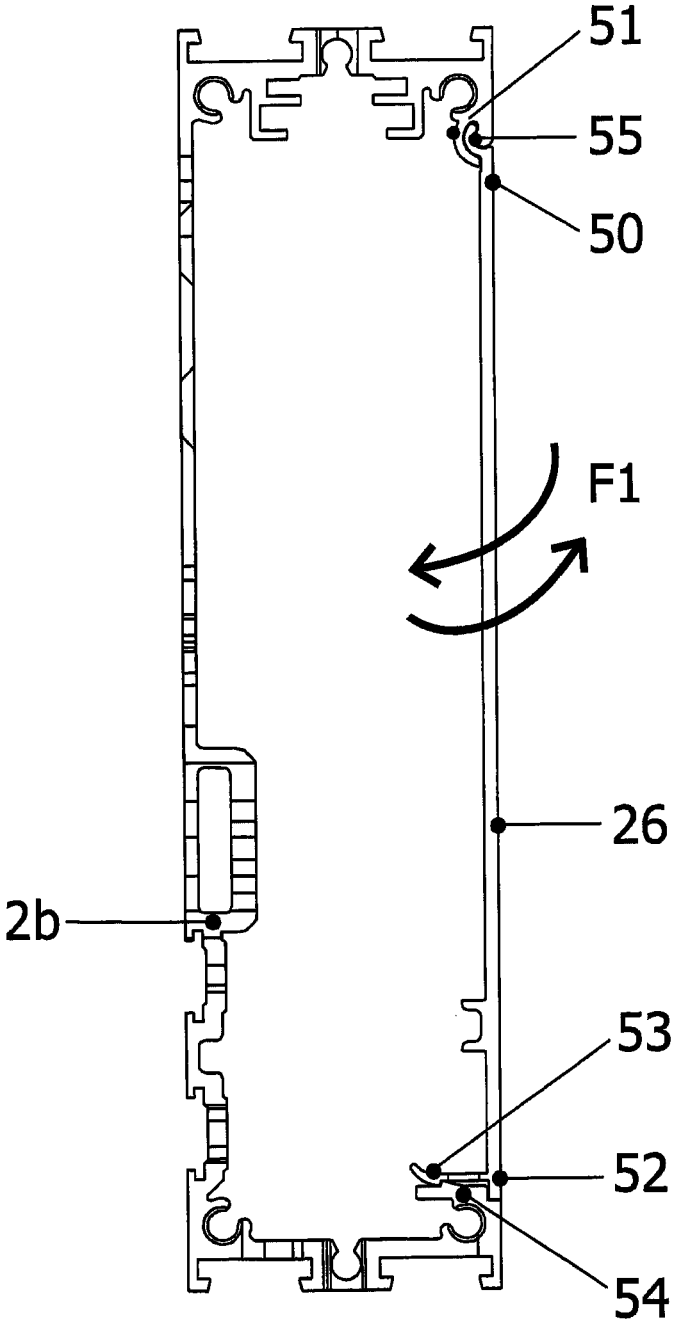
FIGS. 3*a*, 3*b*, 3*c* illustrate the detail of the coupling of the door to the uprights of the fume cupboard of FIG. 1.
Figure 3B:
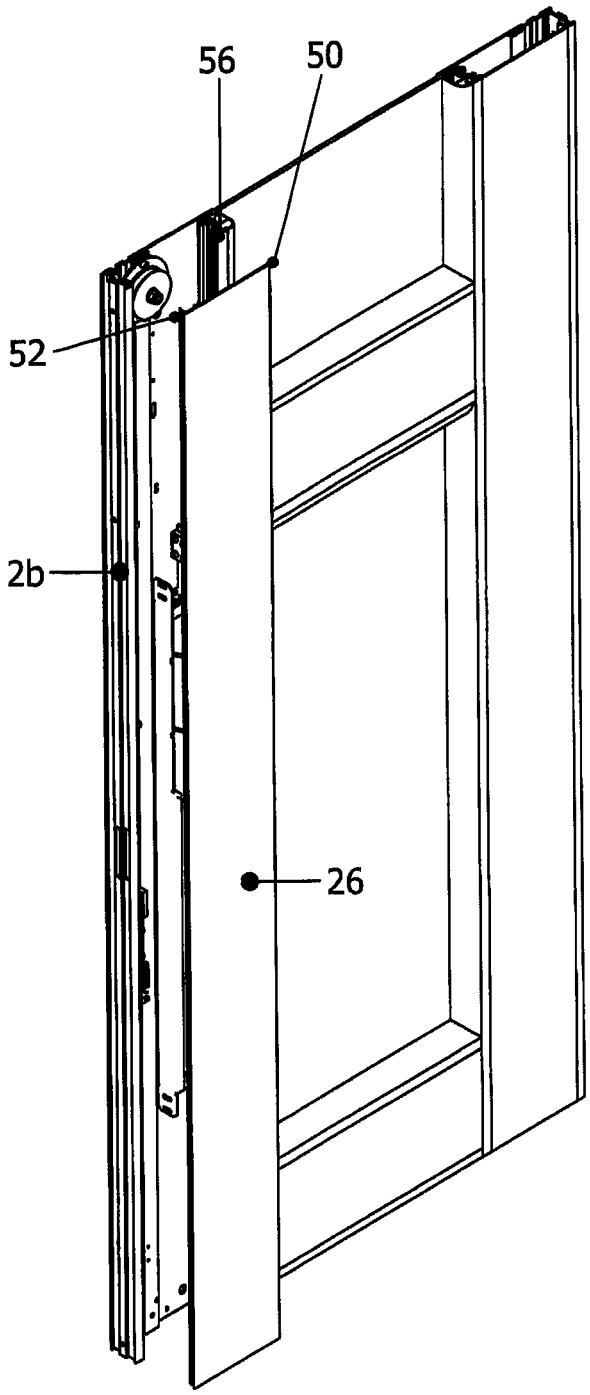

In the embodiment shown in the FIGS. 3*a* and 3*b* the door 26 has a first longitudinal edge 50 which, in cross section, has an arc-shape 55, adapted to house, inside, a seat 56 having corresponding shape, formed on the respective edge 51 of the upright 2*b*. In this way a hinge coupling is substantially achieved, which allows the door 26 to rotate with respect to the upright 2*b* in the direction of the arrows F1 of FIG. 3*a*.

The second longitudinal edge 52 of the door 26, opposite the edge 50, has a tooth 53 which snap-couples with a corresponding counter element 54 provided on the relative inner part of the internal space 25 of the upright 2*b*.

Figure 3C:
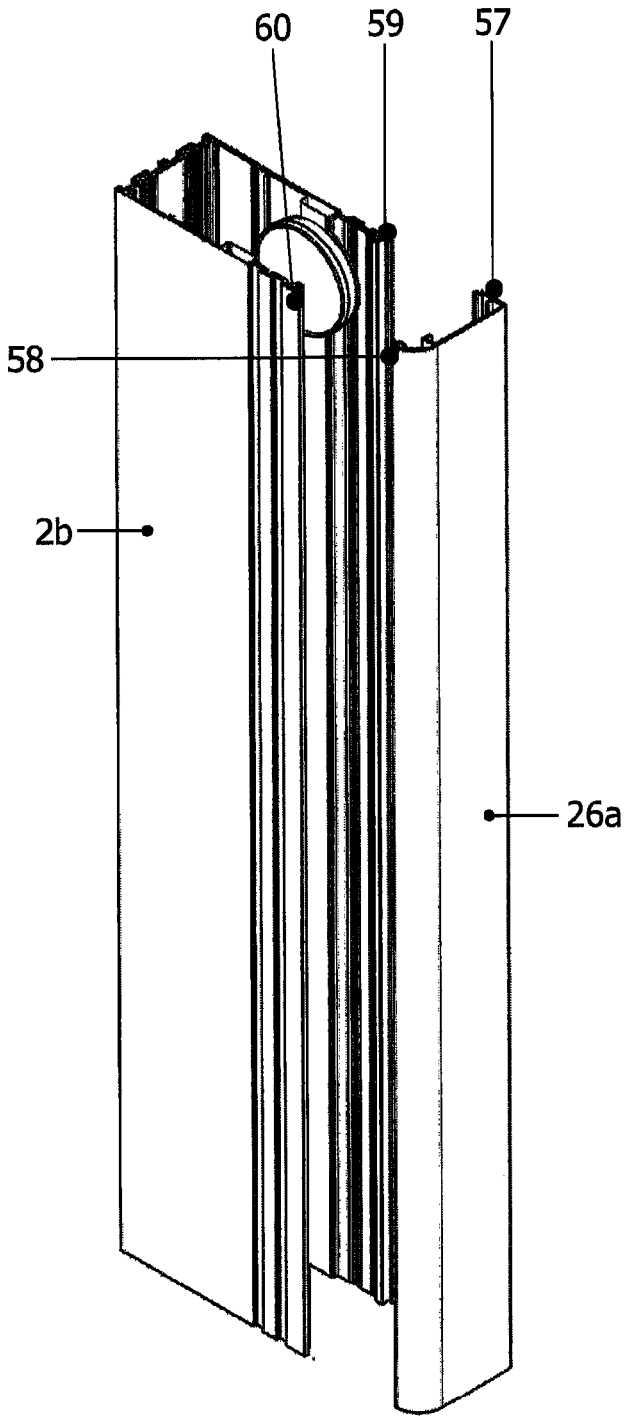
Figure 4:
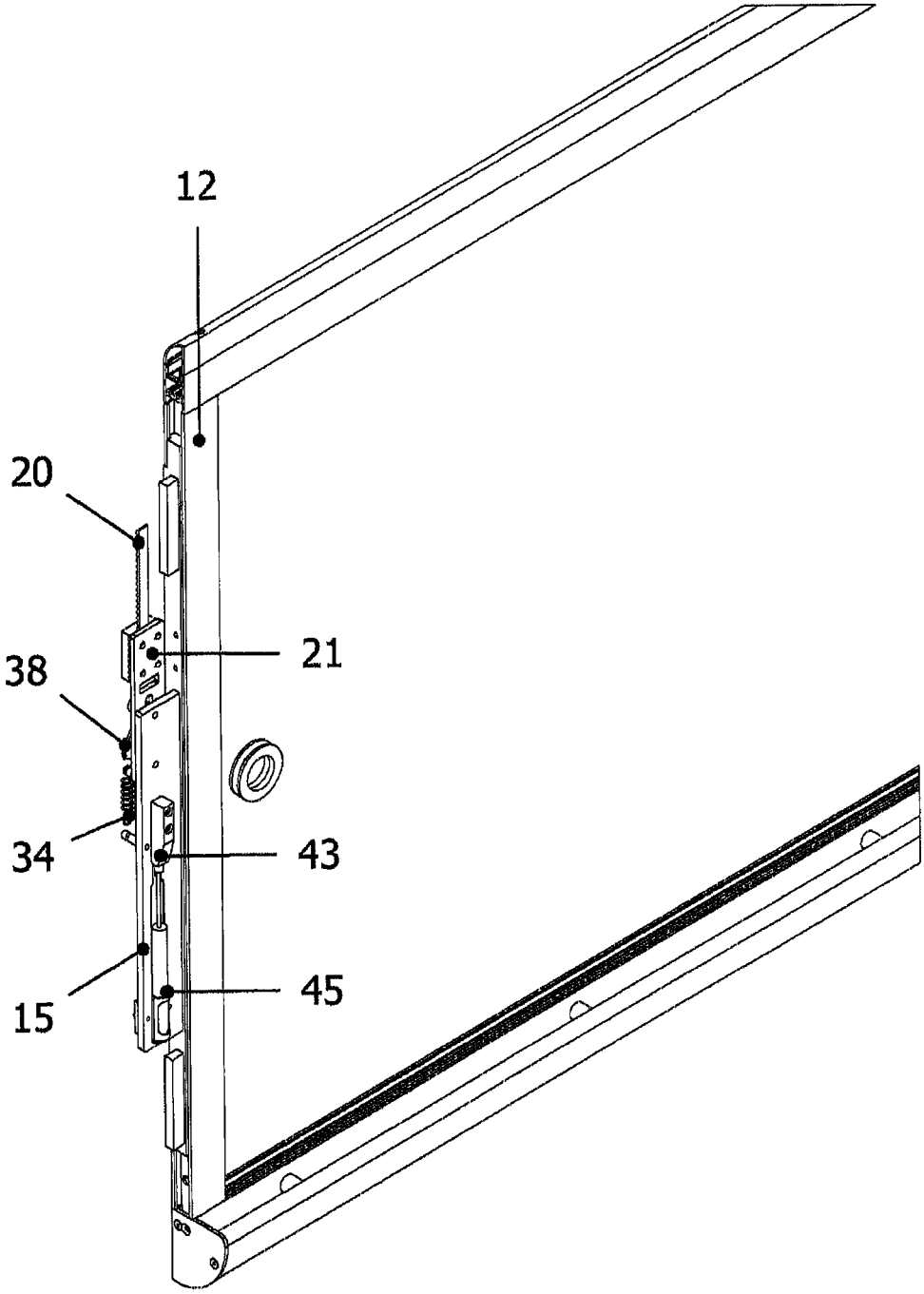
FIG. 4 illustrates the connection of the system of FIG. 3 to the frame of the sash.
Figure 12:
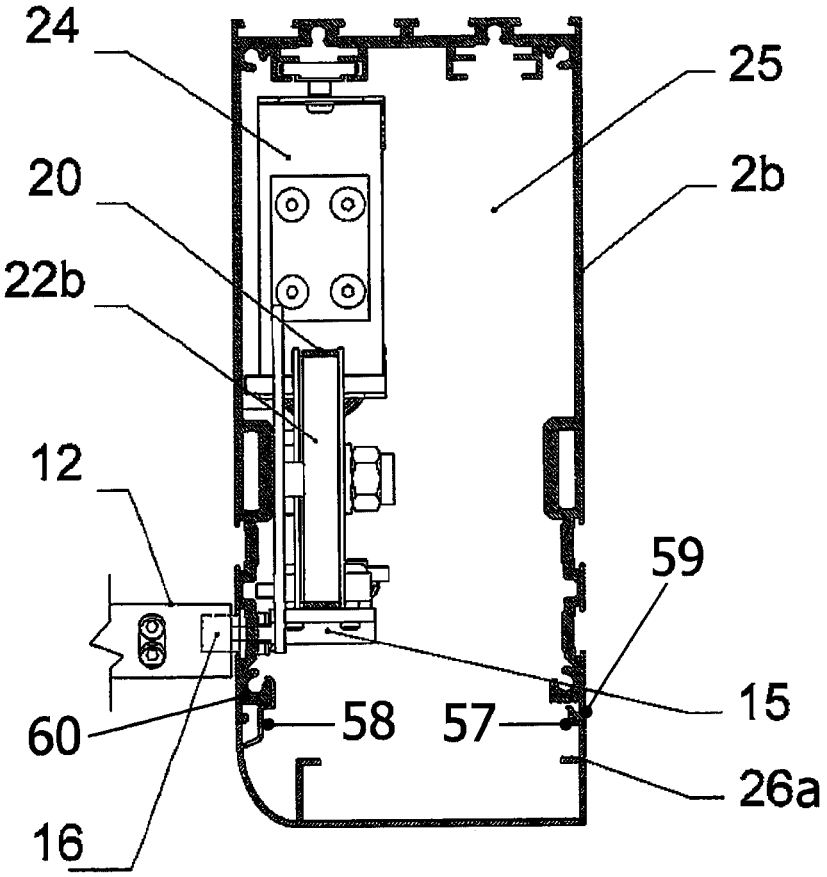
FIG. 12 illustrates a further variation of the fume cupboard of the invention, with sash movement transmission system positioned in the front part of the front uprights.

In the version of FIGS. 3*c* and 12, the upright 2*b* is closed by a front door 26*a*, bearing on the longitudinal edges of tongues 57,58 adapted to snap-couple with the strikers 59,60 provided on the corresponding edges of said upright 2*b*.

The coordination of the movements of the transmission systems 14 housed in the front uprights 2*a* and 2*b* of the fume cupboard 1 is achieved by means of a synchronization shaft 27, better illustrated in FIGS. 6 to 9. In particular the above-mentioned shaft 27 has opposite ends 28 and 29 which are fixed to the respective return pulleys 22*a* and 22*b* of the cogged belt 20 in the corresponding front uprights 2*a* and 2*b*.

Figure 5:
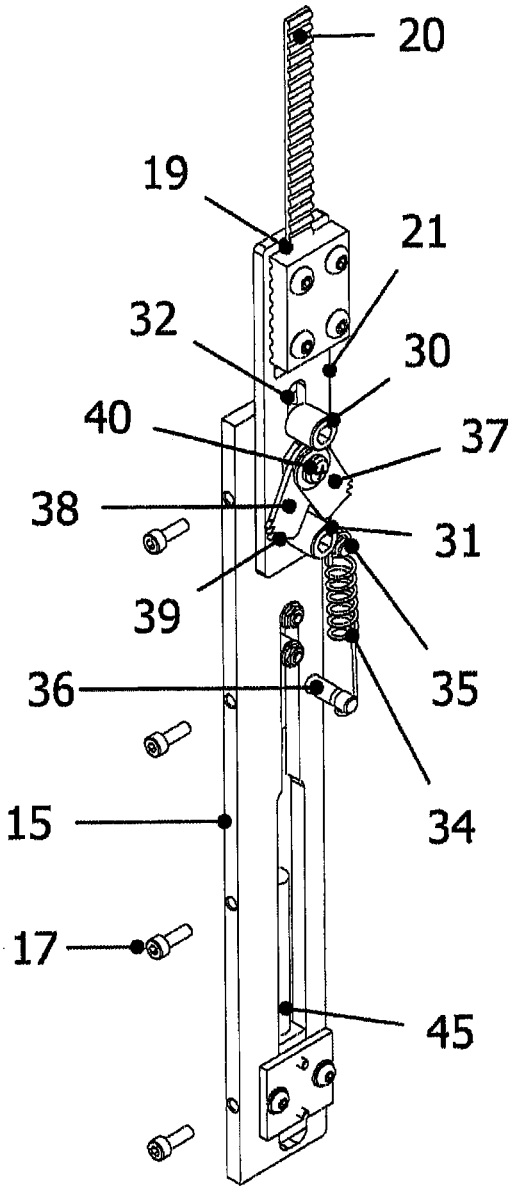
FIG. 5 illustrates in exploded view the connection of FIG. 4.
Figure 6:
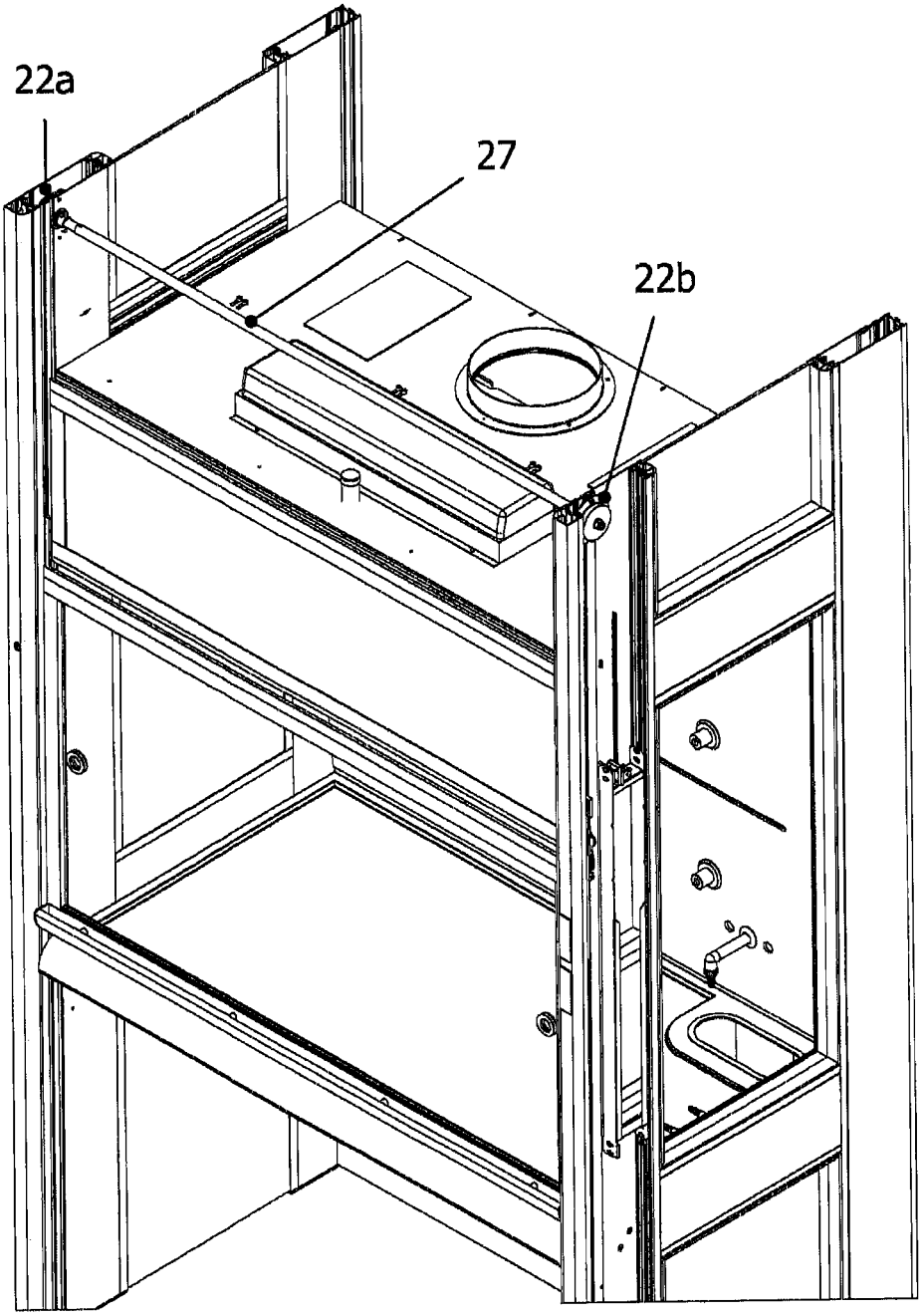
FIGS. 6 to 9 illustrate the detail of the synchronization shaft used on the sash of the fume cupboard of the preceding figures.
Figure 7:
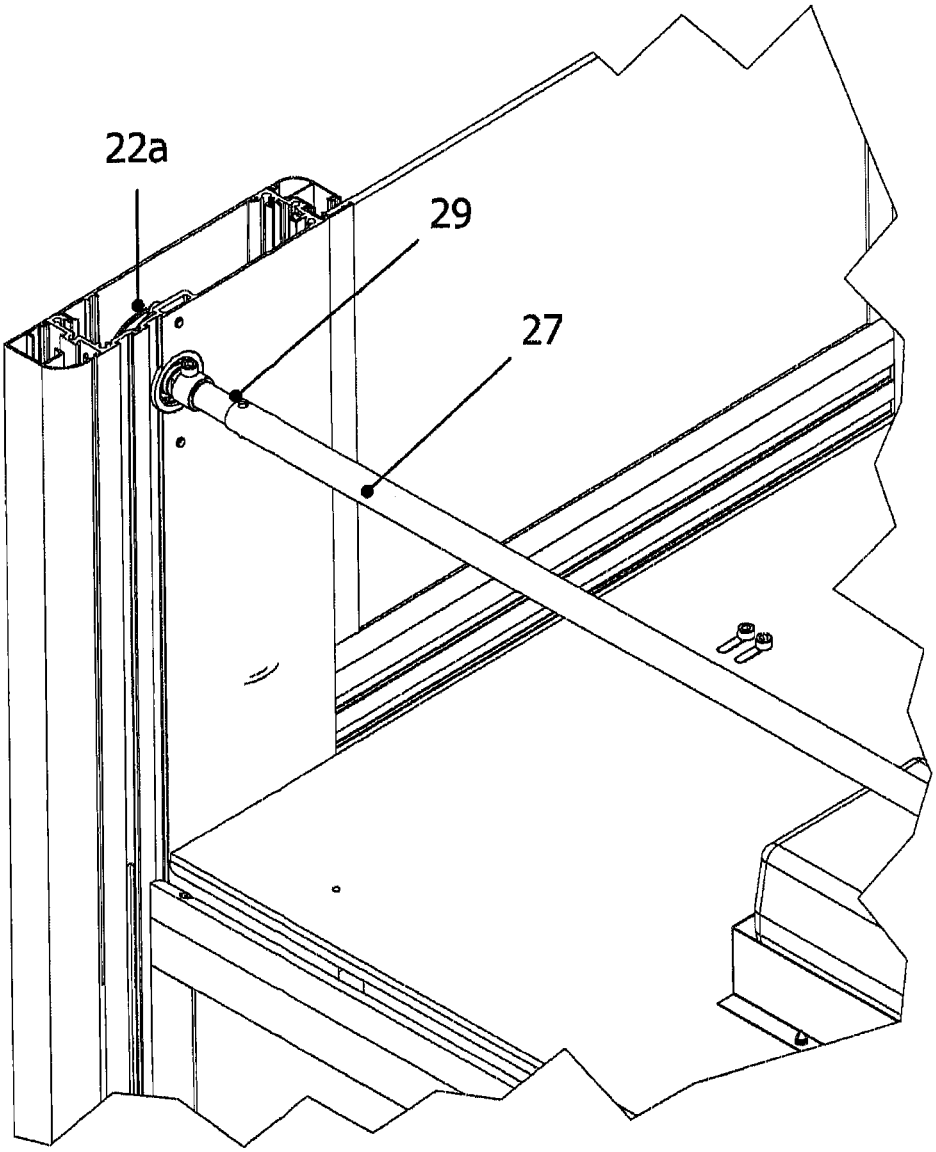
Figure 8:
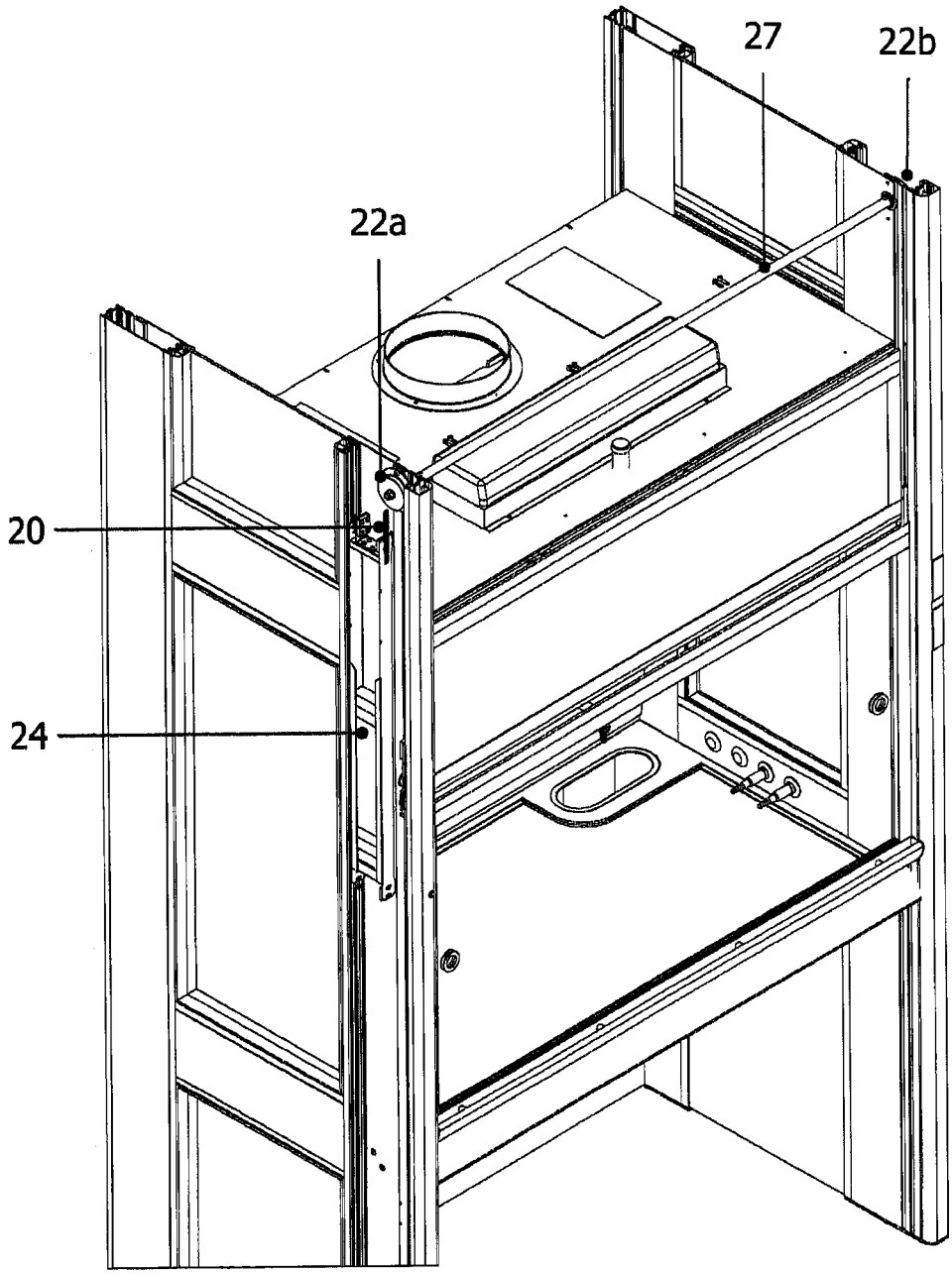
Figure 9:
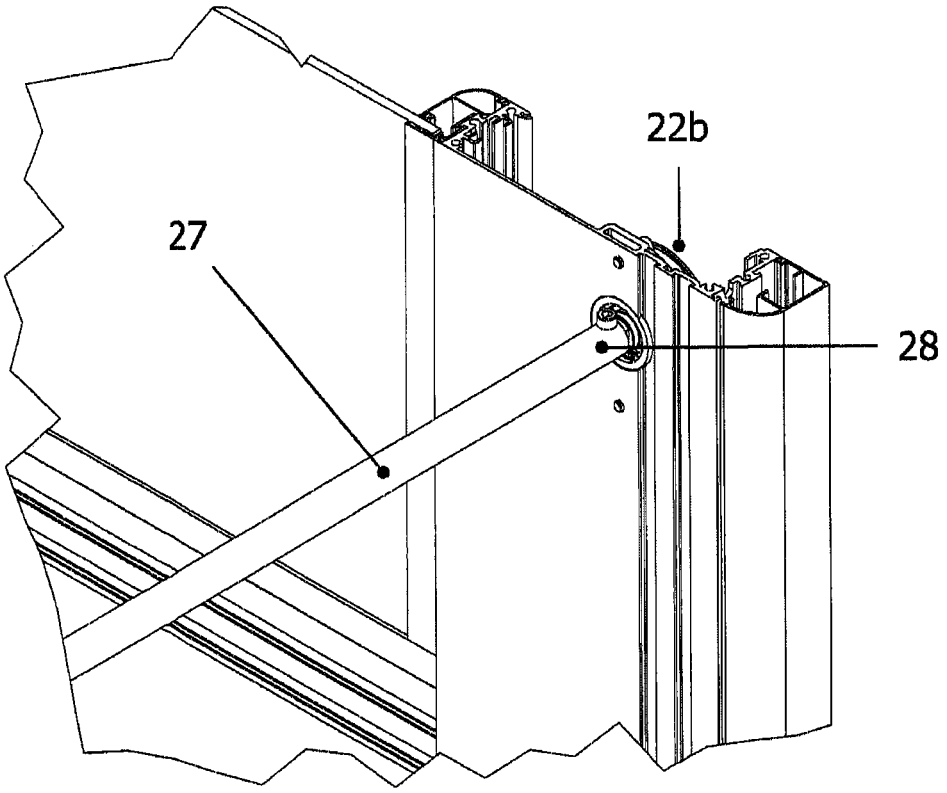
Figure 10A:
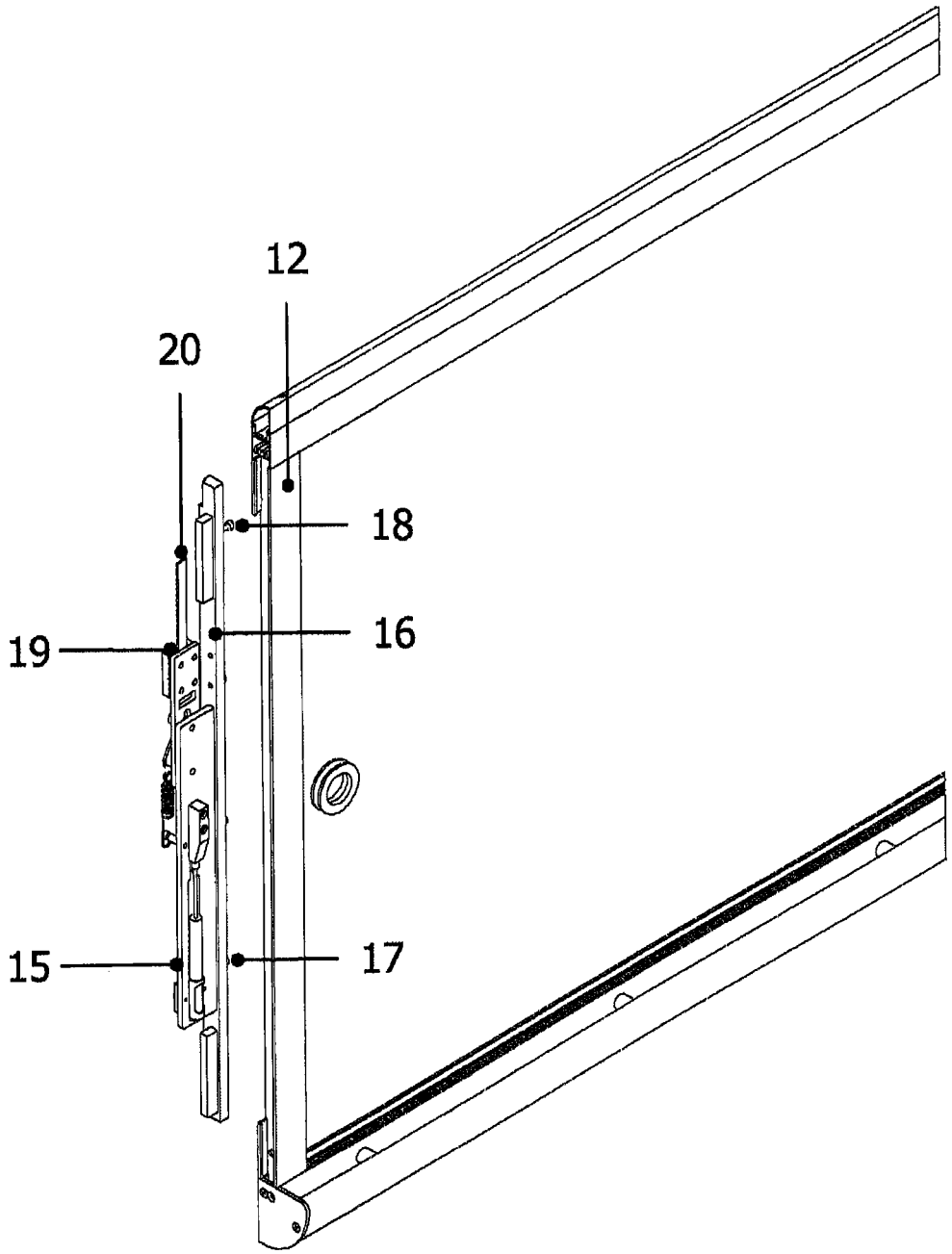
FIGS. 10*a* and 10*b* illustrate the detail of the fitting of the sash frame to the connection of FIG. 4.
Figure 10B:
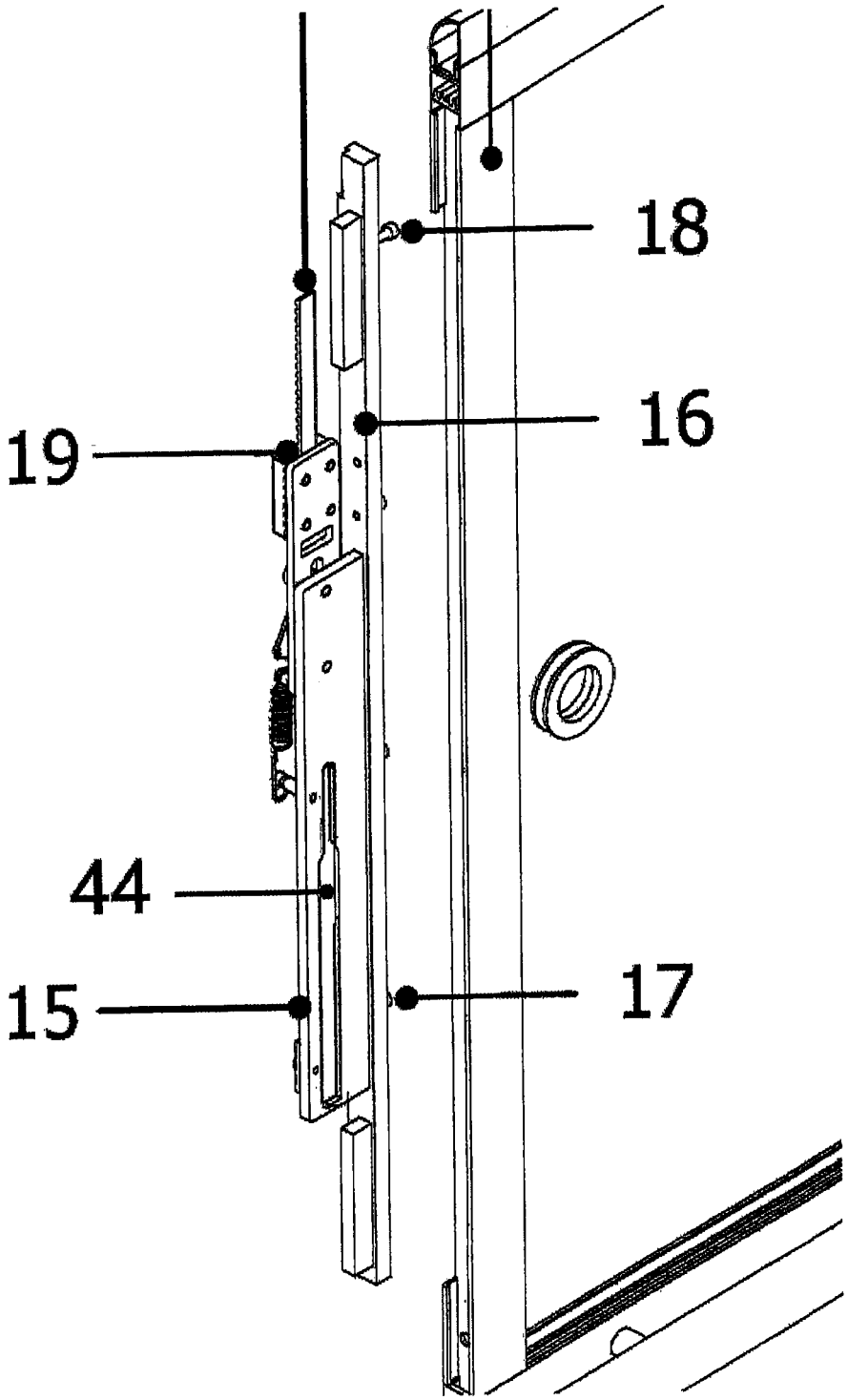
Figure 13A:
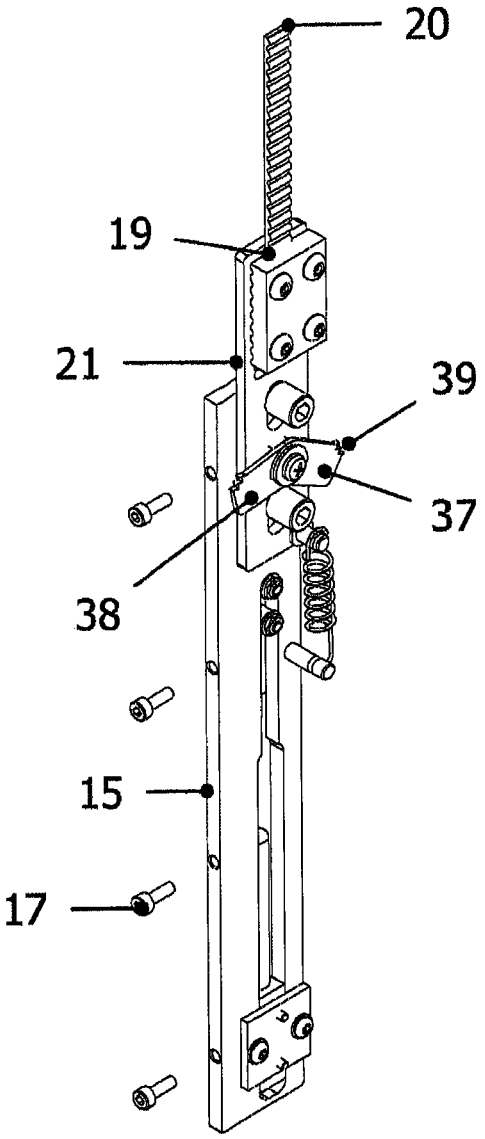
FIGS. 13*a* and 13*b* illustrate the connection of FIG. 5, with the sash movement blocked.
Figure 13B:
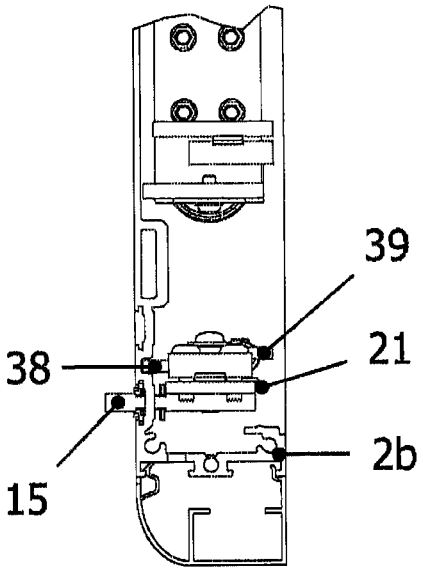

The transmission system 14 to the frame 12 of the sash 4 functions between the state of operation illustrated in FIG. 5 and blocking in conditions of safety illustrated in FIG. 13. For said purpose the above-mentioned transmission system 14 comprises a safety device for blocking the movement of the sash 4, in which the sliding connection of the described bracket 21 on the plate 15 is achieved by means of screws 30 and 31. These are in turn fixed to the same plate 15 and are positioned sliding inside respective slots 32,33 provided on the above-mentioned bracket 21. One end of a spring 34 is furthermore fixed to a pin 35 of the plate 21, while the other end is fixed to a pin 36 integral with the plate 15. This safety system is completed by two tongues 37,38 pivoting on a pin 40 fixed to the sliding bracket 21. The above-mentioned tongues 37,38 have a serrated edge 39, adapted to interfere against the corresponding inner surface 41 of the internal space 25 of the uprights 2*a* and 2*b*, thus stopping the movement of the plate 15 and therefore also of the sash 4.

During normal operation of the sash (FIG. 5), the action of the counterweight 24 overcomes the return force of the spring 34 and the tongues 37,38 are kept in a closed position by rotation around the common pin 40 on the body of the pin 31 of the plate 21.

In the event of breakage of the belt 20, the traction force generated by the counterweight 24 is lacking and, in these conditions, the spring 34 returns the sliding bracket 21 towards the plate 15. This causes interference of the tongues 37 and 38 against the screw 31 of the bracket 21, with consequent rotation thereof around their shared pin 40. This causes the above-mentioned tongues 37, 38 to reciprocally move away until their serrated edge 39 interferes against the inner walls 41 of the internal space 25 of the uprights 2*a* and 2*b*, thus stopping the stroke of the sash 4.

Figure 11:
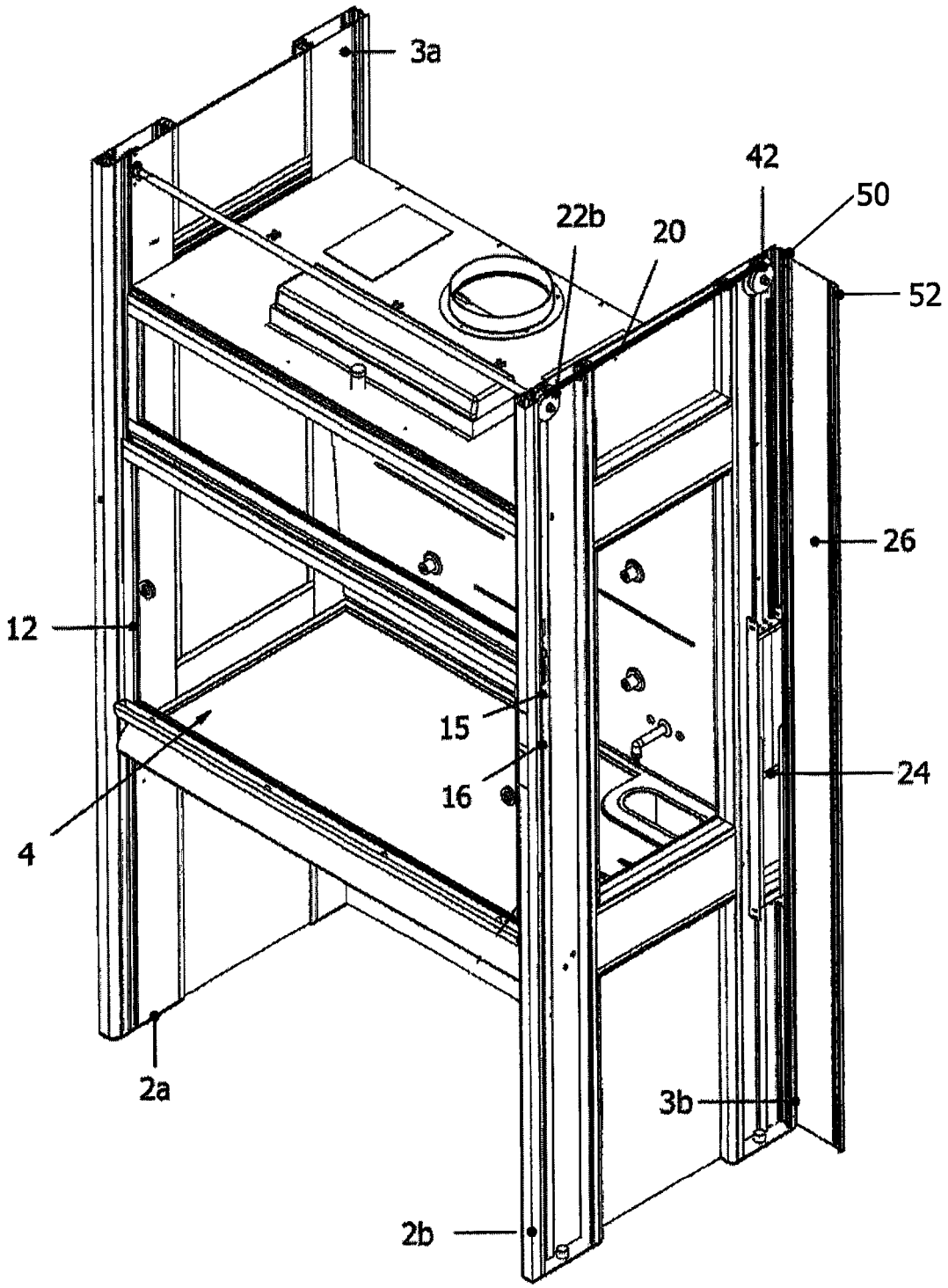
FIG. 11 illustrates a variation of the fume cupboard of FIG. 2, with sash movement transmission system positioned on the side of the front and rear uprights of the fume cupboard.

In the variation illustrated in FIG. 11, on the front uprights 2*a*,2*b* of the fume cupboard 1 the fixing system by plate 15 and block element 16 to the frame 12 of the sash 4 is maintained unchanged. The counterweight 24 is instead moved inside the rear uprights 3*a* and 3*b*, again by means of the belt 20 which in this case also runs through corresponding pulleys 42 arranged at the upper end of the latter. In this case also the side panels and the rear uprights 3*a*,3*b* of the fume cupboard 1 will have an internal space 25 closed by a cover 26, similarly to what is described for the front uprights 2*a*,2*b*.

In the variation of FIG. 12 the transmission system for transmitting the movement to the sash 4 is housed in the front part of the front uprights 2*a*,2*b* of the fume cupboard 1, with the same procedure as described for the preceding figures.

Figure 14:
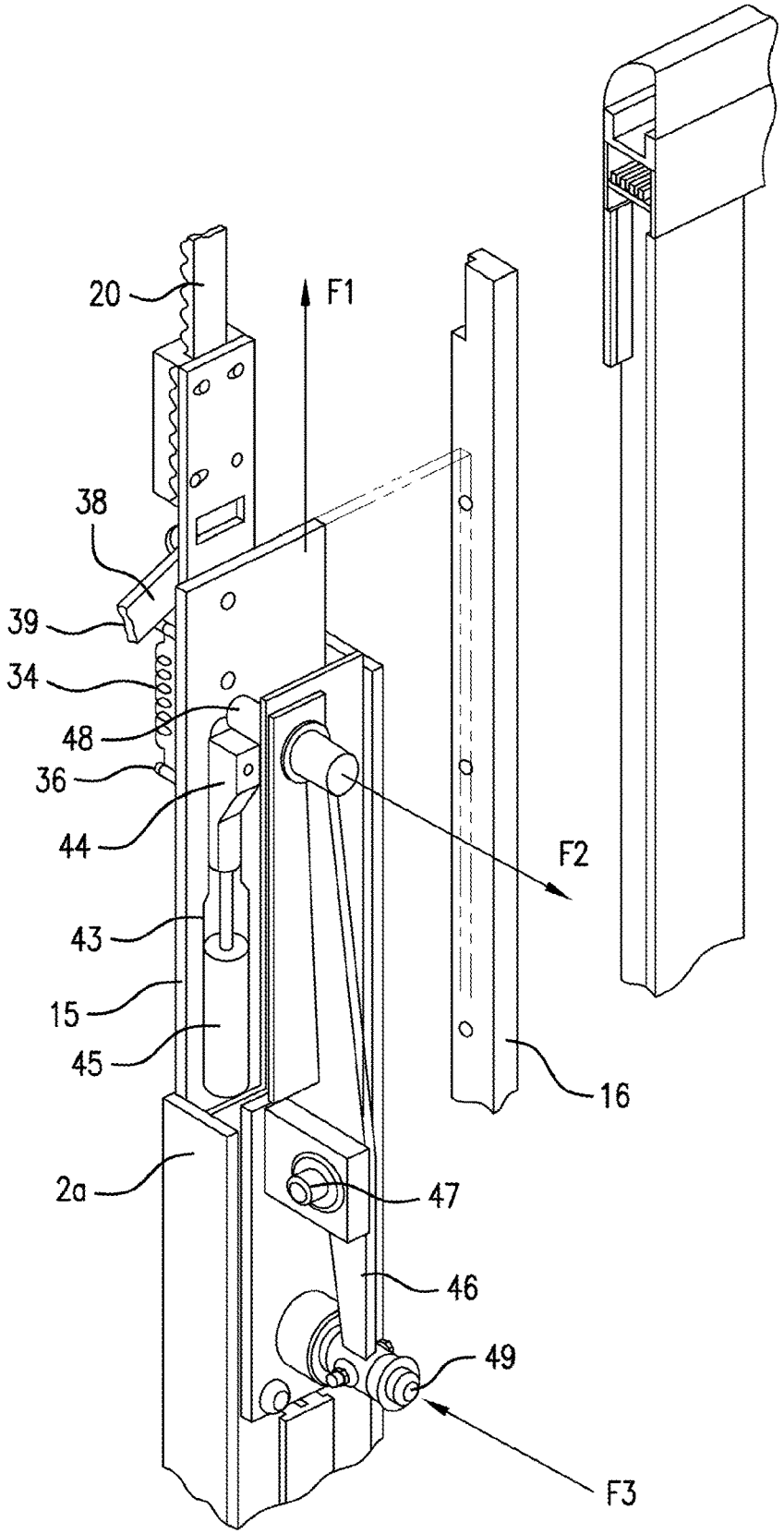
FIGS. 14 to 16 illustrate blocking of the opening of the sash in an intermediate position.
Figure 15:
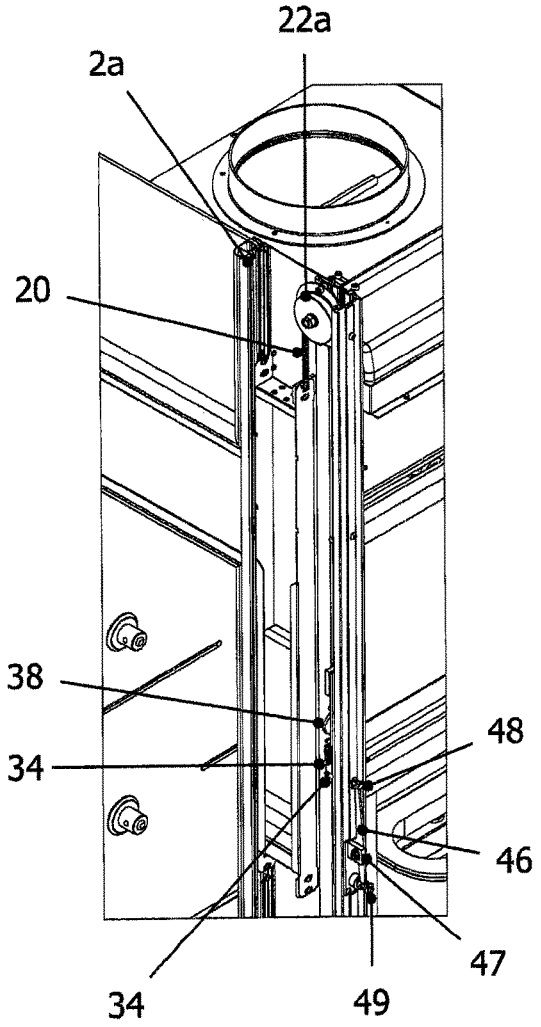
Figure 16:
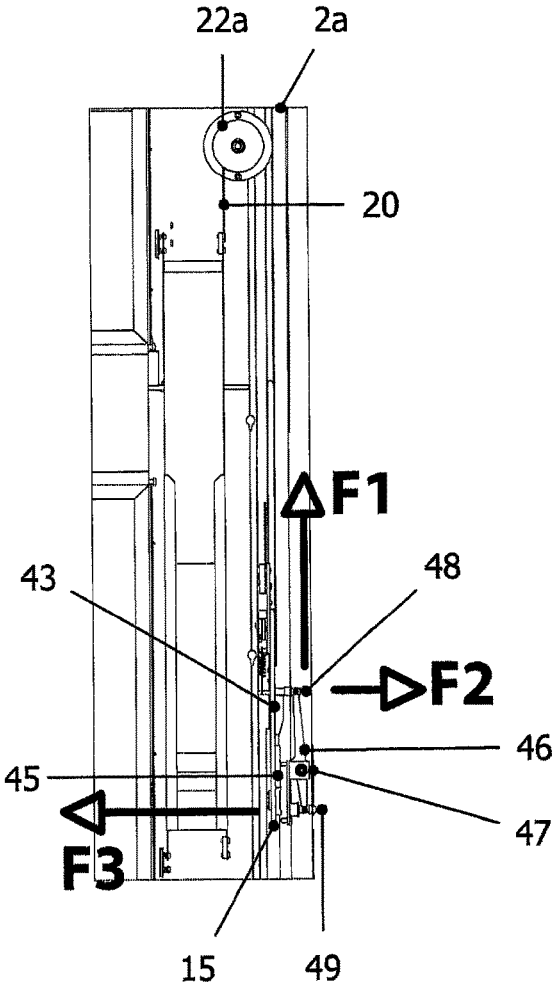

According to a preferred embodiment of the invention, the connection of the plate 15 to the frame 12 of the sash 4 includes a friction stop mechanism to stop the movements of the sash, as illustrated in FIGS. 14 to 16. This mechanism comprises a block element 43, made of plastic material or other, fixed projecting onto the surface of the plate 15 facing the front of the upright in which the transmission system 14 is housed. In turn, the block element 43 is arranged sliding inside a slot 44 obtained on the above-mentioned plate 15, counter to a friction piston 45 connected to the above-mentioned block element 43. On the same upright a lever 46 is also fixed, oscillating on a plane perpendicular to that of the plate 15 and rotating around a pin 47 fixed to the plate 15 (arrow F2 of FIG. 14). The upper end of the lever 46 has a pin 48, projecting towards the plate 15 and arranged in a position of interference with the block element 43 in the upward stroke of the plate 15 (arrow F1 of FIG. 14). A button 49 for releasing the above-mentioned upward stroke of the sash 4 is also provided.

When the command is given to the sash 4 to move back up in the direction of the arrow F1, the pin 48 interferes with the block element 43, thus causing slowing down and stopping of said upstroke movement by the friction produced by the piston 45. When the button 49 is pressed subsequently, it causes oscillation of the lever 46 in the direction of the arrow F2, moving the pin 48 away from the plate 15 and from the relative block element 43, thus allowing complete upward movement of the sash and complete opening of the inner chamber 10 of the fume cupboard 1.

Modifications can be made to the invention as described above and illustrated in the attached figures, to produce variations which nevertheless fall within the scope of the following claims.

Thus, for example, the counterweight 24 could be replaced by a linear lead screw with an electric or manual control.

The invention claimed is:

1. A fume cupboard, of the type comprising a framework with two front uprights (2*a*, 2*b*), two rear uprights (3*a*, 3*b*), a rear panel (11), two side panels (6,7), an upper panel (8) and a sash (4) consisting of a frame (12) and at least one panel (13) for closing an inner chamber (10) of said fume cupboard (1), characterized in that it is provided with a transmission system (14) for transmission of vertical movements of said sash (4) located inside the front uprights (2*a*, 2*b*), or inside said front uprights (2*a*, 2*b*) and said rear uprights (3*a*, 3*b*), the front uprights and rear uprights (2*a*, 2*b*;3*a*,3*b*) having an internal space (25) for housing said transmission system (14), in which said internal space (25) is provided with an opening facing the outside of the cited fume cupboard and in which said opening is closed by a door (26,26*a*).

2. The fume cupboard according to claim 1, characterized in that the transmission system (14) is located in a side of the uprights of said fume cupboard (1).

3. The fume cupboard according to claim 1, characterized in that said transmission system (14) is located in a front part of the front uprights (2*a*,2*b*).

4. The fume cupboard according to claim 1, characterised in that said door is a side door (26) having a first longitudinal edge provided with a hinge coupling with a corresponding longitudinal first edge of said upright (2*b*) and a second longitudinal edge provided with a snap coupling with a corresponding longitudinal second edge of the same upright (2*b*).

5. The fume cupboard according to claim 4, characterised in that the first longitudinal edge (50) of said door (26) has an arc-shape (55), which is housed inside a seat (56) of corresponding shape, formed on the respective edge (51) of the upright (2*b*).

6. The fume cupboard according to claim 5, characterized in that said side door (26) has a second longitudinal edge (52), opposite the first longitudinal edge (50), provided with a tooth (53) which snap-couples with a corresponding counter element (54) provided on the corresponding inner part of the internal space (25) of the upright (2*b*).

7. The fume cupboard according to claim 1, characterized in that said door is a front door (26*a*), bearing, on longitudinal edges thereof, tongues (57,58) adapted to snap-couple to strikers (59,60) provided on the corresponding edges of said upright 2*b*.

8. The fume cupboard according to claim 1, characterized in that said transmission system (14) comprises a transmission belt (20), the end (19) of which is fixed to the frame (12) of the sash (4), while the other end (23) is fixed to a counterweight (24) or to a linear lead screw with an electric or manual control, at least one return pulley (22,42) for said belt (20) being furthermore provided pivoted to the uprights of the fume cupboard (1).

9. The fume cupboard according to claim 8, characterized in that said transmission system (14) has a pulley (22) for returning the belt (20) inside the front uprights (2*a*, 2*b*) and a pulley (42) for returning said belt (20) inside the rear uprights (3*a*, 3*b*).

10. The fume cupboard according to claim 1, characterized in that it comprises furthermore a synchronization shaft (27) for synchronizing the movements of said transmission systems (14) housed in the uprights of the fume cupboard (1), in which the opposite ends (28, 29) of said shaft (27) are fixed to respective return pulleys (22*a*, 22*b*) for returning a belt (20) in the corresponding front uprights (2*a*, 2*b*).

* * * * *